US005233968A

United States Patent [19]

Vannucci

[11] Patent Number: 5,233,968

[45] Date of Patent: Aug. 10, 1993

[54] PERCUSSION SAWING MACHINE TO SAW STONE BLOCKS INTO SLABS

[76] Inventor: Pier L. Vannucci, Via Filattiera, 45, 54031 Avenza, Italy

[21] Appl. No.: 859,361

[22] PCT Filed: Nov. 22, 1990

[86] PCT No.: PCT/EP90/01994

§ 371 Date: May 20, 1992

§ 102(e) Date: May 20, 1992

[87] PCT Pub. No.: WO91/07263

PCT Pub. Date: May 30, 1991

[30] Foreign Application Priority Data

Nov. 22, 1989 [IT] Italy ..... 22472 A/89

[51] Int. Cl.[5] ..... B28D 1/06; B28D 1/26

[52] U.S. Cl. ..... 125/16.01; 125/14; 125/16.03

[58] Field of Search ..... 125/16.01, 16.03, 17, 125/19, 14; 51/59

[56] References Cited

U.S. PATENT DOCUMENTS

| | | | |
|---|---|---|---|
| 10,844 | 6/1887 | Foerster | 125/16.01 |
| 1,347,365 | 7/1920 | Fletcher | 125/1 |

FOREIGN PATENT DOCUMENTS

| | | | |
|---|---|---|---|
| 172858 | 7/1906 | Fed. Rep. of Germany . | |
| 296493 | 8/1915 | Fed. Rep. of Germany . | |
| 0809774 | 3/1952 | Fed. Rep. of Germany | 125/16.01 |
| 0921157 | 1/1947 | France | 125/19 |
| 1006643 | 4/1952 | France . | |
| 1008422 | 5/1952 | France . | |
| 0487264 | 11/1953 | Italy | 125/16.01 |
| 0496507 | 12/1955 | Italy | 125/16.03 |
| 205172 | 11/1923 | United Kingdom . | |

*Primary Examiner*—Robert A. Rose

*Attorney, Agent, or Firm*—Young & Thompson

[57] ABSTRACT

The invention concerns a percussion sawing machine to saw stone blocks-particularly granite-into slabs, of the type comprising a stiff support framework, a blade frame (6) performing an alternate movement inside said framework along a substantially horizontal and at least partly rectilinear trajectory, means (20-25, 30-35) to suspend the blade frame (6) to said framework, and means (3, 9) to control the vertical translation of said suspension means. According to the invention, along said rectilinear part of the trajectory, one or more rapid jumping movements of small amplitude are imparted on the blade frame (6) in a vertical direction, so as to determine corresponding blade percussions onto the bottom of the respective channels cut into the stone block.

9 Claims, 6 Drawing Sheets

PERCUSSION SAWING MACHINE TO SAW STONE BLOCKS INTO SLABS

BACKGROUND OF THE INVENTION

1. Field of the Invention

The present invention concerns a percussion sawing machine to saw stone blocks into slabs. As known, these machines essentially consist of a fixed part, acting as support, and of a movable part which comprises the oscillating blade frame.

The fixed part consists of a stout framework comprising four vertical steel columns, fixed at the bottom to a reinforced concrete foundation and connected at the top by four steel cross members. A large worm screw is positioned inside each vertical column and the four screws are caused to rotate simultaneously by suitable motor means. Each screw then carries, in a screw-and-nut relationship, a corresponding lead nut to which is fixed the movable part of the sawing machine.

The movable part essentially consists of a horizontal rectangular blade frame, into which is fixed a set of parallel and suitably tensioned saw blades, consisting of steel plates having a scarcely thick rectangular cross section. The dimensions of the blade frame are substantially equal to the inner dimensions of the fixed part of the sawing machine, into which said frame oscillates moving simultaneously downwards so as to perform the cutting of the block into slabs.

In the sawing technique making use of the aforedescribed machines, the steel blades of the blade frame simply have the function to apply the actual stone cutting medium, which consists of a thick slurry of water and abrasive material. Said slurry is constantly circulated over the stone block being cut by a suitable pump positioned into a tank provided under said stone block, wherein the slurry is collected. Different types of abrasive material are of course used, according to the kind of stone block being cut: sand has traditionally been used for sawing marbles, whereas a mixture of steel grit and lime is adopted for granites. The slurry is periodically or continuously reactivated by adding fresh abrasive material, so as to make up for that consumed in the cutting operation.

In all the sawing machines adopted at present, the oscillating movement of the blade frame is of the hunting type, obtained by fixing said frame to the fixed part of the machine by means of four rocking arms connected—freely rotatable by way of hinged joints—by one end to the four corners of said blade frame and by their opposite end to the previously cited lead nuts.

With this type of construction, during the alternate huntings of the blade frame each point of the single saw blades describes a circle arc trajectory, of radius equal to the length of the rocking arms and of maximum chord (commonly called "travel") equal to twice the length of the crank of the connecting rod-crank system imparting the alternate motion to the blade frame. The effective part of this travel, namely that in which the abrasive cutting action actually takes place, is obviously only that in which the blades are in contact with the stone block to be cut, being therefore—from a theoretical point of view—only the central point of the hunting travel. In the remaining part of their travel, the blades rise from the bottom of the respective channels cut into the stone block, allowing a further essential function of the sawing machine to be performed, namely the outlet from the cutting channels of the consumed slurry and the simultaneous feeding of fresh slurry required for the sawing operation.

In actual fact, the effective contact length between the blades and the block being cut is far longer and, taking also into account the partial deflection of the blades tensioning system while they bear onto said block, the average values of the contact length are equal to 30–35% of the travel, in sawing machines having rocking arms about 1 meter long. Said value—also known as abrasion ratio—directly answers for the sawing speed and thus for the productivity of the machine.

2. Description of the Prior Art

Numerous studies have been carried out since several years and different solutions have been proposed to rise said abrasion ratio beyond the aforespecified values, namely to increase the period of the abrasive action in respect of the period in which the blades are not in contact with the bottom of the cutting channels, allowing the slurry to be fed. The feeding of this latter should in fact be fast enough and be equally regular, even if the period in which the blades part from the bottom of the cutting channels were to be far shorter than in the case of conventional sawing machines.

The different solutions proposed by technique to supply sawing machines with an increased abrasion ratio can be divided into two categories, namely machines with a hunting travel and machines with a rectilinear travel. The first category comprises machines which, though adopting different constructive solutions, keep to the traditional arrangement of the blade frame suspended to rocking arms; the second category includes instead machines which slide or roll onto suitable supports, so as to travel at least partly on a straight line.

In the sawing machines of the first category, the most obvious solution has evidently been to increase the length of the rocking arms, so as to thus increase the radius of the hunting movement of the blades, flattening their trajectory, without modifying the arc shape of said trajectory. This system allows to increase the abrasion ratio to about 50%, but nevertheless brings the total height of the machine to unacceptable values, both for the overall dimensions involved and for the excessive flexibility thus acquired by the framework.

A more recent solution, always belonging to the first category of sawing machines, consists in replacing the conventional hinged joints by double-acting hinged joints. In this case, the rocking arms are not directly pivoted on the axis of the hinged joint, but onto an eccentric rotating inside the joint. This allows to vary the length of the rocking arm, during the hunting travel, from a minimum in correspondence of the central point of the travel, to a maximum in correspondence of the dead centres, thereby realizing the desired flattening of the blades trajectory. Also in this case, the abrasion ratio can be increased to about 50%, but this solution introduces in the sawing machine a rather delicate mechanical member, as the double-acting hinged joint, which is not apt to stand for long the high stresses involved. Thus, in addition to a higher initial cost, this solution also requires frequent operations of maintenance and repair.

Furthermore, a feature common to all the types of sawing machines belonging to the aforementioned first category, is that the blades arc trajectory is strictly tied to the dimensions of the structural parts of the machine, and particularly to those of the rocking arms. Said trajectory is thus calculated once for all when the machine is under production and can no longer be modified during the useful life of the machine, unless the same were to be totally restructured.

Concerning the sawing machines of the second category, it should be observed at once that none of them has found up to date an appreciable industrial application, though the first studies in this field date back to the start of the century. The DE-C-172 858, dating back to 1904, describes in fact a sawing machine of this type, wherein the blade frame slides onto four straight tracks, by way of wheels pivoted idle to the corners of said frame and laterally provided with pins cooperating with a guide rack. This document also teaches to vary the shape of the tracks, or that of the wheels, so as to obtain sliding trajectories of the blade frame wherein the blades part from the bottom of the cutting channels, both at the two dead centres of their travel and, possibly, in correspondence of a central point, thereby allowing an improved feeding of the abrasive slurry in the cutting area.

This second category also includes the FR-A-1 008 422, which describes a sawing machine with rectilinear travel, wherein the sliding takes place between a substantially flat support and a circular wheel, which can be respectively fixed onto the lead nuts movable on the screws and onto the blade frame, or viceversa. Also this document teaches the possibility to part the blades from the stone block being cut, at the opposite ends of the travel and, possibly, also in the centre, so as to allow feeding the abrasive slurry.

The sawing machine described in FR-A-1006643 is an example of another embodiment of a rectilinear travel sawing machine. In this case in fact the movement of the blade frame—in a different way from what it occurs in the two previous cited patents—it is obtained through a toothed wheel and rack. The sawing machine has also a vibration system of the cutting elements operated by compressed air or by cams, acting in the two directions perpendicular to the principal movement direction of the cutting elements themselves.

As specified heretofore, none of the above solutions has found a practical industrial application, in spite of offering—in theory—the possibility to realize sawing machines with an abrasion ratio positively higher than those according to prior art and, furthermore, apt to be programmed at will by simply replacing the sliding tracks. The reasons for said unsuccessful results are probably determined by two independent causes.

On one hand, the fact that the construction of this type of sawing machines is more complex and thus more costly than that of conventional sawing machines and, furthermore, that it is not easy—from the technical point of view—to realize a construction of the sliding and rolling members which would not suffer from the drawbacks determined by saw dust and sludge, met in the sawing of stone blocks. It should in fact not be forgotten that, even slight deposits of material onto the sliding surfaces, can considerably alter the wanted trajectory of the blade frame or even hamper the regular working of the sliding and rolling members.

On the other hand the fact that, possibly, the higher abrasion ratio obtainable—in theory—with sawing machines having a rectilinear travel path, could even—in practical application—not be effectively utilized, due to the requirement of feeding the cutting channels with fresh abrasive slurry. It does not seem in fact a mere coincidence that the first two above cited documents should provide for the possibility to lift the blades from the bottom of the cutting channels at the centre of the travel, just in order to fulfil said requirement. It is hence legitimate to think that the increase in the abrasion ratio—obtainable in practice with sawing machines with rectilinear travel—is not so significant as to make up for the financial burdens deriving from the more complex structure of said machines and from the fact that the market trend is totally in favour of sawing machines with hunting travel.

SUMMARY OF THE INVENTION

The inventor of the present invention has set up a sawing machine to saw stone blocks, and particularly granite, which belongs to the second of the aforespecified categories, namely that of sawing machines with a rectilinear travel. The object of the invention is in fact to supply a sawing machine with rectilinear travel wherein, in correspondence of the abrasion zone and in addition to the conventional translatory motion, the blade frame is provided with a hammering or percussion movement of the saw blades onto the stone block being cut, that is, a short and rapid Jumping movement which causes the blades to be lifted from the bottom of the cutting channels and then be dropped again therein. To reach this object, the inventor has had to work out a series of technological and structural improvements on the sawing machine with rectilinear travel, so as to allow its effective industrial application which had not been accomplished up to date; all such improvements hence fall into the scope of the present invention.

The object of the present invention is thus reached with a percussion sawing machine to saw stone blocks—particularly granite—into slabs, of the type comprising a stiff support framework, a blade frame performing an alternate movement inside said framework along a substantially horizontal and at least partly rectilinear trajectory, means to suspend the blade frame to said framework, and means to control the vertical translation of said suspension means, said machine being characterized in that said means to suspend the blade frame comprise four oscillating support devices, fixed to the four corners of the blade frame, each consisting of a cam member which bears in rolling relationship on a corresponding track, the cam member being pivoted idle on a pin fixed to the blade frame and the bearing track being fixed to said vertical translation means or vice versa, each oscillating support device also comprising a pair of cooperating toothed elements, fixed respectively to the cam member and to the bearing track, so as to allow their rolling relationship without skidding, and in that said toothed elements comprise one or more teeth of further depth in respect of the normal coupling profile, so as to impart to the blade frame, along said rectilinear part of the trajectory, one or more rapid jumping movements of small amplitude in a vertical direction, apt to determine corresponding blade percussions onto the bottom of the respective channels cut into the stone block.

BRIEF DESCRIPTION OF THE DRAWINGS

The invention will now be described in further detail with reference to the accompanying drawings, which show some preferred embodiments thereof illustrated by way of example, and in which:

FIG. 5A is a cross section view, along the lines V—V of FIGS. 5B and 5C, of a second embodiment of the oscillating support device for the blade frame according to the present invention;

DESCRIPTION OF THE PREFERRED EMBODIMENTS

Figure 1:
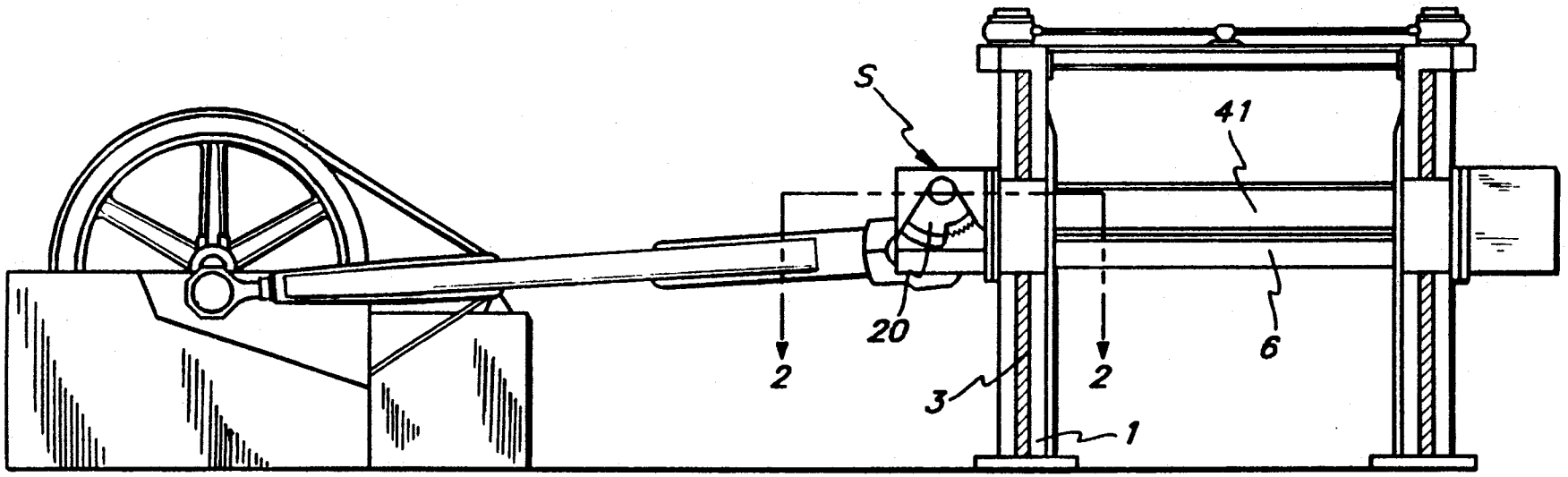
FIG. 1 is a diagrammatic side elevation view of the sawing machine according to the present invention.
Figure 2:
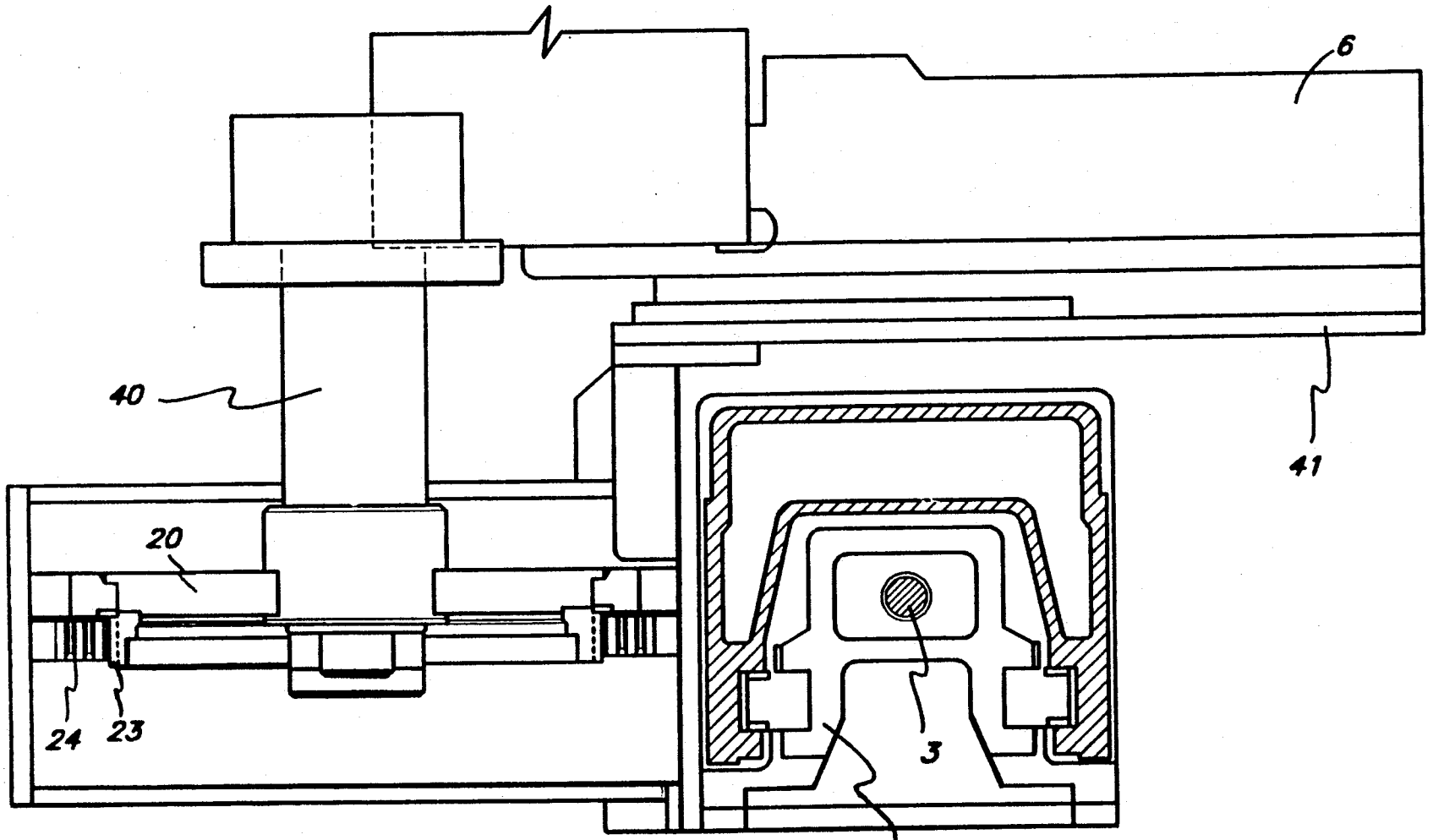
FIG. 2 is a part section view along the line II—II of FIG. 1.
Figure 3:
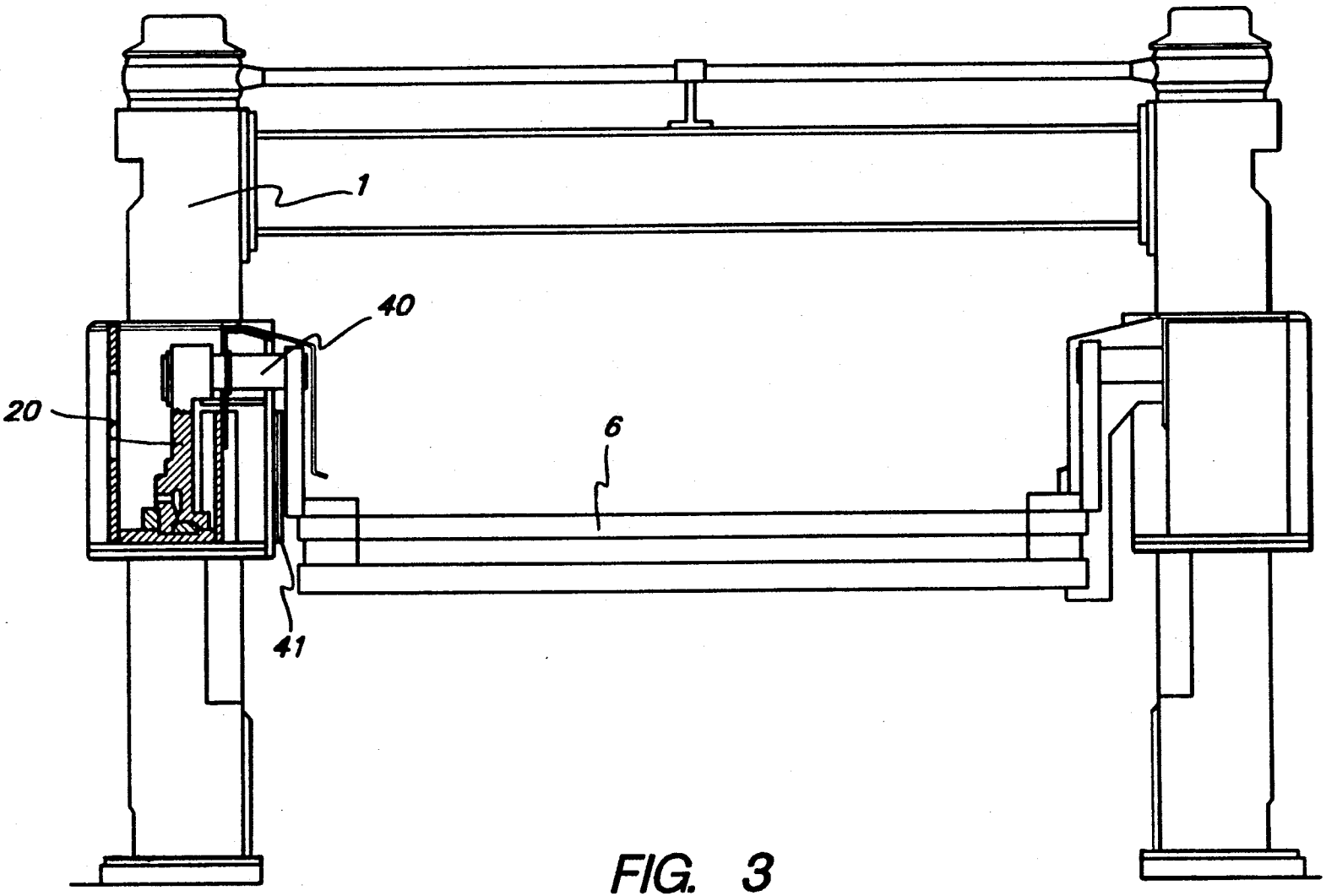
FIG. 3 is a diagrammatic part section front elevation view of the sawing machine according to the present invention.

FIGS. 1 to 3 show diagrammatically a sawing machine assembly according to the present invention, wherein it appears quite evident how the oscillating device S, supporting the blade frame 6, is positioned substantially on the same level of said frame, thereby allowing to construct far lower sawing machines, which turn out to be more economic than the conventional ones, though preserving their stiffness.

In these figures, it can also be noted how—compared to conventional technique—it has been possible to change the position of engagement of the lead nut 9 with the screw 3, from a side one to a front one, with considerable advantages as far as accessibility, and also for what concerns the problems caused by saw dust and sludge, to which the screws—in this position—are now far less subjected.

Finally, in order to guarantee a greater stiffness of the oscillating support devices S, positioned cantilevered in respect of the columns 1, the same are preferably connected in pairs by stiffening crosspieces 41, positioned along the sides of the machine between the blade frame 6 and the columns 1.

Figure 4C:
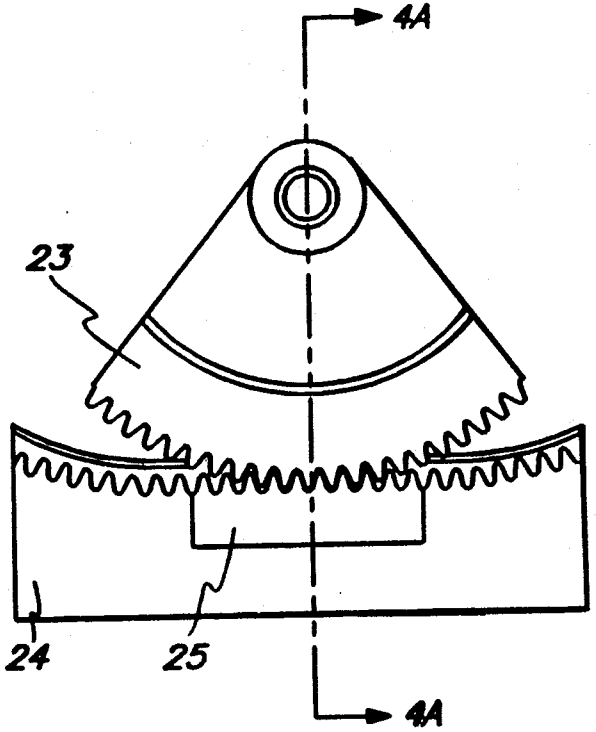
FIGS. 4B and 4C are side elevation views, respectively of the opposite faces of the device shown in FIG. 4A.
Figure 4A:
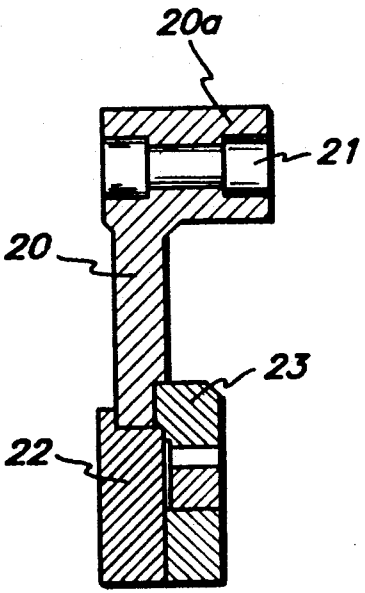
FIG. 4A is a cross section view, along the lines IV—IV of FIGS. 4B and 4C, of an oscillating support device for the blade frame according to the present invention.
Figure 4B:
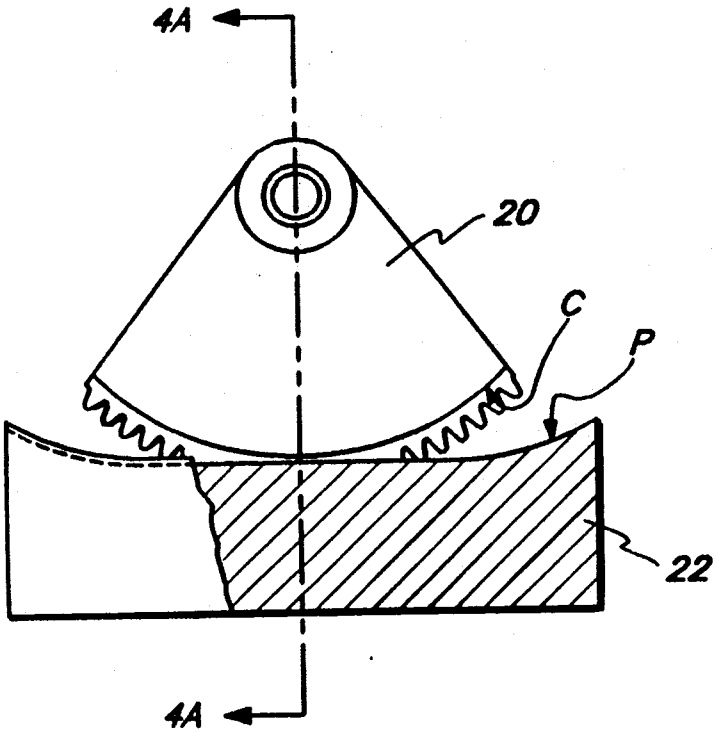
Figure 5C:
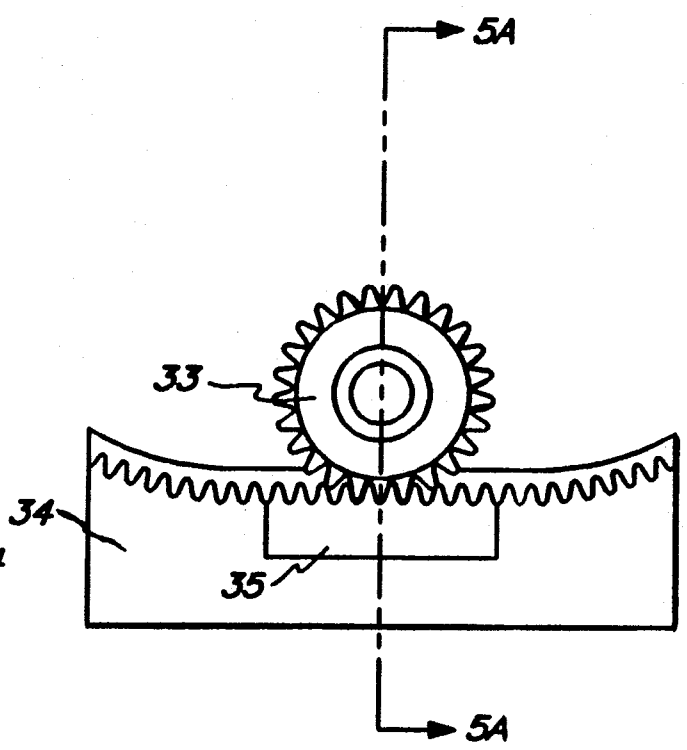
FIGS. 5B and 5C are side elevation views, respectively of the opposite faces of the device shown in FIG. 5A.
Figure 5B:
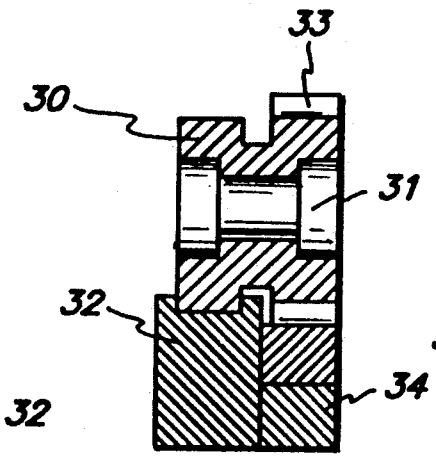
Figure 5B:
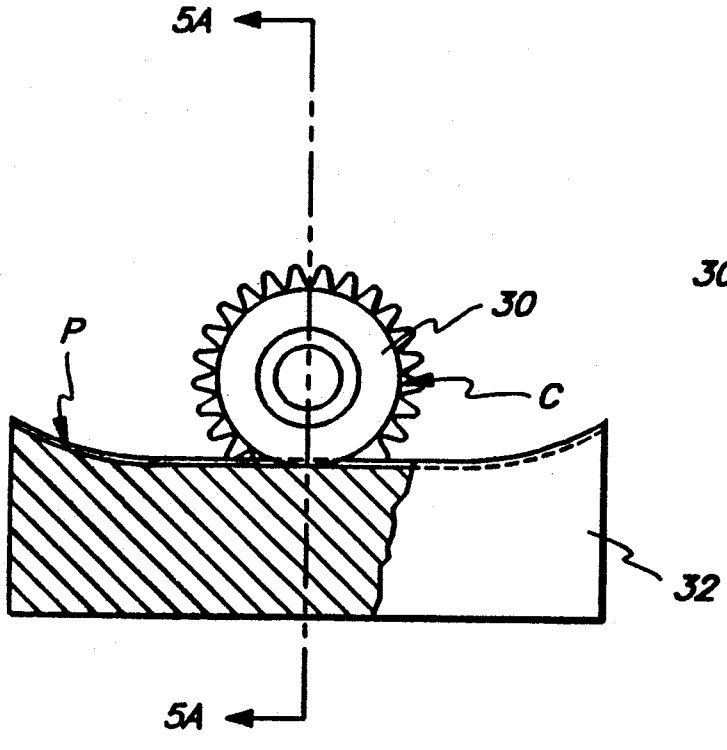

According to the present invention, the oscillating support devices S are positioned substantially in correspondence of the corners of the blade frame 6, and—as also shown in FIGS. 4 and 5—they comprise cam members 20, 30, pivoted idle on suspension pins 40 fixed to the blade frame 6; said cam members 20, 30, bear on rolling tracks P of corresponding supports 22, 32, each of which is fixed to a conventional lead nut 9 moved, in known manner, by a respective screw 3. Devices are also provided to prevent skiddings between each cam member and its respective bearing and rolling track.

According to the constructive solution proposed by the present invention, the trajectory of the blade frame 6 can be planned at will, by simply varying the contour C of the cam member 20, 30, that of the respective rolling track P, or both. In particular, one can thereby easily provide for a central part of the blade frame trajectory to be perfectly rectilinear, reserving merely to the end parts of said trajectory the lifting of the blade frame required to feed the slurry into the cutting channels; alternatively, one can even provide for the whole trajectory to be rectilinear, in the event of finding different slurry feeding systems which do not require lifting of the saw blades from the bottom of the cutting channels. The abrasion ratio can thus be increased exactly to the desired extent, up to the theoretical maximum of 100%, thereby allowing to increase the productivity of the sawing machine in a determining way.

With the present sawing techniques, and particularly with the current slurry feeding technique, it has experimentally been found that the abrasion ratio allowing the highest cutting yield is included between 65% and 75%. The particular embodiments described hereinafter show therefore abrasion ratios falling into this range.

A first embodiment of the oscillating support device which characterizes the sawing machine of the present invention is illustrated in FIG. 4, in two lateral views (B and C) and in a cross section view (A). In this embodiment, the cam member is shaped as a circular sector 20, ending at the top with a shoulder 20*a*, into which is formed a hole 21 for housing one of the four suspension elements of the blade frame 6. Said suspension elements simply consist of horizontal pins 40 (FIGS. 2 and 3), welded or otherwise rigidly fixed to the blade frame 6, close to the end parts of its sides positioned parallel to the motion direction of said blade frame. Said pins 40 are mounted idle into the holes 21, whereby the sector 20 is free to oscillate in respect of the blade frame 6.

The sector 20, or, more precisely, its cam part C having a circle-arc contour—bears onto a rolling track P formed into a support 22. Said support 22 is in turn rigidly fixed to the movable element of a conventional vertical translatory device of the blade frame 6, for example the already mentioned lead nut 9 moved by a respective screw 3, as shown in FIG. 2.

To allow the cam part C to roll onto the track P without skidding—which is indispensable in order to guarantee both the correct reproduction of the wanted trajectory and the perfect synchronism between the four support devices S of the blade frame 6—to the circular sector 20 there is associated a toothed circle ring sector 23, which cooperates with a toothed element 24, whose pitch line is similar to the profile of the rolling track P of the support 22 to which it is fixed. With this arrangement, while the cam part C rolls onto its bearing track P, the circle ring sector 23 engages with the toothed element 24, thereby preventing skidding between said cam part and the track P.

By suitably varying the profile of the track P of the support 22, it is possible to obtain the wanted trajectory of the blade frame 6. In particular, the rectilinear part of said trajectory corresponds exactly to the length l of the rectilinear part of the track P, while the extent to which the blade frame 6 is lifted in the dead centers, depends on the greater or lesser concavity of the opposite ends of the track P.

In the embodiment shown in FIG. 4, the sector 20 has a circular contour, while the profile of the track P is partly rectilinear and partly curved. Equally satisfactory could be a configuration in which the track P has a perfectly rectilinear profile, while the circular contour of the sector 20 has a smaller radius in the central part and a wider radius in the end parts.

FIG. 5 illustrates—in two lateral views (B and C) and in a cross section view (A)—a second embodiment of the oscillating support device according to the present invention, wherein the cam member is a rotor 30, provided with a hole 31 for housing the suspension pins 40 of the blade frame 6. A toothed unit 33, here in the form of a gear, is formed in one piece with the rotor 30. In a similar way to the previous embodiment, the cam contour C of the rotor 30 bears onto a track P of a support 32, while the gear 33 meshes with a toothed element 34, whose pitch line is similar to the profile of the track P. Said profile determines the trajectory of the blade frame 6.

As mentioned in the introductory part, the main object of the present invention is to supply a sawing machine wherein the blade frame is apt to perform, as well as the conventional translatory motion, also a percussion movement. For this purpose, in both the embodiments described heretofore, the toothed element 24, 34, is formed with its central rectilinear part 25, 35, provided with one or more teeth M of increased depth in respect of the normal coupling profile. In this way, the toothed unit 23, 33, meshing with the element 24, 34, in correspondence of said teeth M, undergoes a short and rapid upward movement which causes the parting of the cam contour C from the respective bearing and rolling track P.

Said upward movement, which obviously takes place simultaneously on all four oscillating support devices of the blade frame, produces a quick lifting of the blade frame, followed—as soon as, after a very short time, the tooth M disengages from the unit 23, 33—by a sudden dropping of the blade frame, thereby allowing to obtain the desired percussion of the saw blades onto the bottom of the respective cutting channels. Laboratory tests, carried out by the inventor, show that said percussion movement—probably due to the combined action of impact and partial refeeding of slurry at the bottom of the cutting channels—leads to an exceptional increase of the cutting speed, which can exceed by two to five times the cutting speed obtained with the conventional sawing machines.

Figure 6:
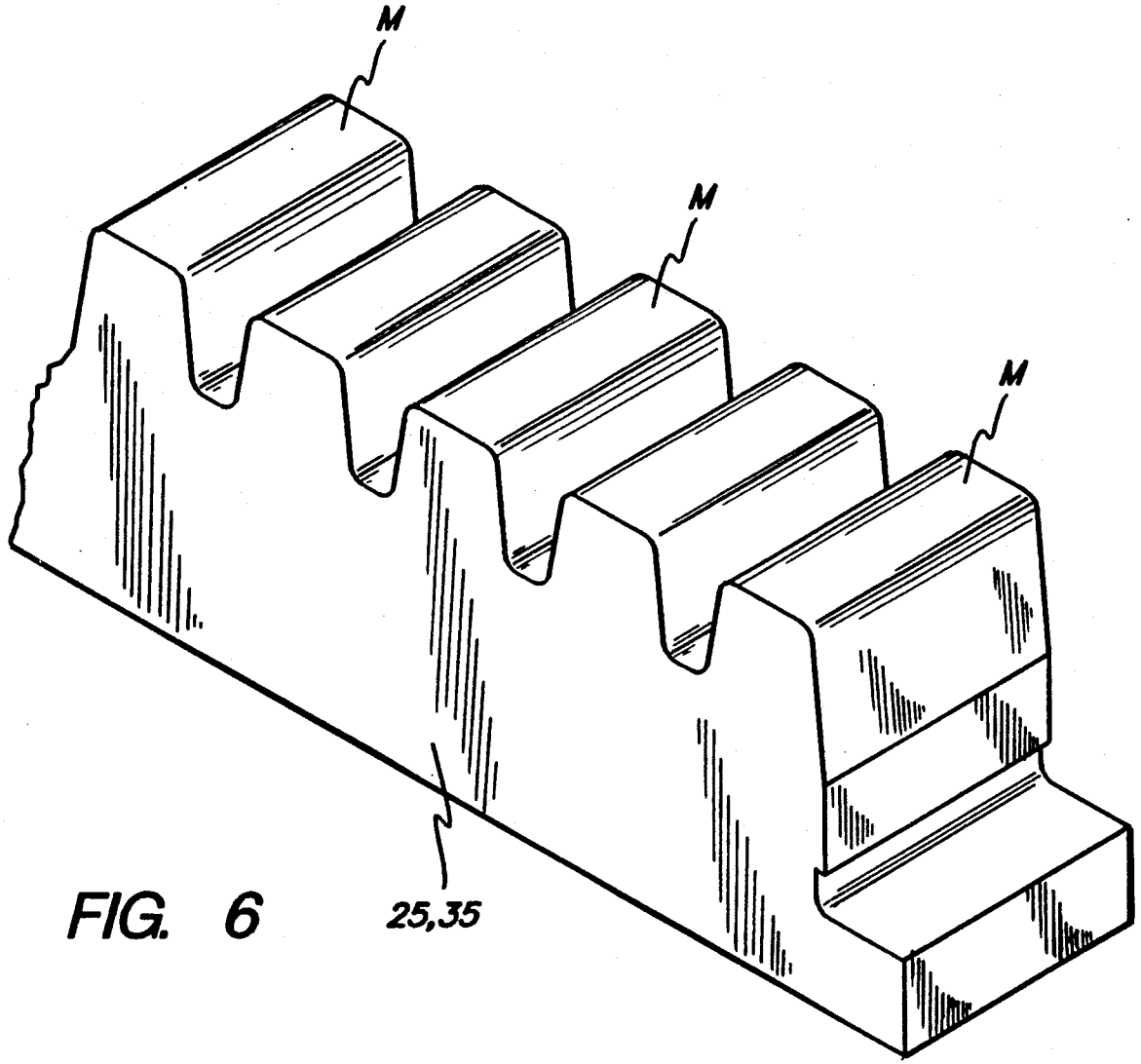
FIG. 6 is a perspective view, on an enlarged scale, showing the detail of the removable part of the toothed element.

The number of percussions can be varied at will, by increasing the number of teeth M on the rectilinear part 25, 35, of the element 24, 34. Preferably, the teeth M are alternated with normal teeth—as shown in FIG. 6—so as to impart on the blade frame a uniform sequence of uninterrupted percussions along the whole trajectory of the toothed unit 23, 33, engaging said part 25, 35, of the toothed element 24, 34.

The impact strength of each percussion is determined, as well as obviously by the increased depth of the teeth M in respect of their normal profile, also by their speed in "releasing" the toothed unit 23, 33, after having lifted it to the maximum height and thus having spaced to the greatest possible extent the cam contour C from the profile of the sliding track P.

For what concerns the increased depth of the teeth M, it is evident that the higher said increase the stronger the impact of each percussion. On the other hand, if said depth increase should be too high, the blade frame acquires a high kinetic energy during the lifting step, due to the high masses involved, and this, besides requiring an excessive amount of energy, also creates problems of mechanical strength of the oscillating support devices of the blade frame. Studies carried out by the inventor have proved that the increase in depth of the teeth M should preferably be between 0.3 and 10 mm. With depth increases below 0.3 mm, the impact strength of the percussion is in fact not sufficiently high to fully accomplish the objects of the invention; whereas, with depth increases exceeding 10 mm, one starts to feel the negative consequences described hereabove. A preferred depth increase would be between 1 and 5 mm.

For what concerns the speed at which the teeth M disengage from the toothed unit 23, 33, it is also here evident that the higher said speed the stronger the impact of the percussion, seen that this simultaneously determines an increase in the downward speed of the blade frame and, thus, in the kinetic energy acquired by said frame when dropping onto the bottom of the cutting channels. In planning the kinematism of the sawing machine according to the present invention and, in particular, the speed at which the teeth M disengage from the toothed unit 23, 33, another problem should anyhow be borned in mind. In fact, if the vertical acceleration rate at which the teeth M disengage from the toothed unit 23, 33, exceeds the acceleration of gravity, it is possible to have a parting between the toothed unit 23, 33, and the corresponding toothed element 24, 34, with a consequent possible mutual displacement. To prevent this drawback, the invention provides for an upper guide track, (not shown) through which the two aforespecified toothings are always strictly kept in mutual contact.

As it appears evident from the previous description, the central rectilinear part 25, 35, of the toothed element 24, 34, is subject—together with the toothing of the unit 23, 33—to considerable wear, due to the constant impact stresses undergone by the same. According to the present invention, it is therefore possible to advantageously provide for said central rectilinear part 25, 35, to be removable from the remaining part of said element 24, 34, so as to allow its easy replacement. In this case, said part 25, 35, shall be suitably formed of a softer material than that forming the toothed units 23, 33, so as to concentrate the wear exclusively on said part 25, 35, which—as said—is easily interchangeable.

The invention finally provides for a device (not shown) by means of which the position of the rectilinear part 25, 35, of the toothed element 25, 35, can be adjusted in height. This allows both to recover, at least partly, the wear of the teeth M, and to adjust—according, for example, to the kind of stone block being cut—the dropping height and, thus, the impact strength of percussion of the blade frame.

The invention has been described with reference to some specific embodiments thereof, but it is evident that its scope extends to all the sawing machines with rectilinear travel providing for a rapid upward and downward motion of the blade frame—of small amplitude in a vertical direction—with an impact effect on the stone block being out.

I claim:

1. Percussion sawing machine to saw stone blocks into slabs, comprising a stiff support framework, a blade frame performing an alternate movement inside said framework along a substantially horizontal and at least partly rectilinear trajectory, means to suspend the blade frame from said framework, and means to effect vertical translation of said suspension means, said means to suspend the blade frame comprising four oscillating support devices, fixed to four corners of the blade frame, each consisting of a cam member which bears in rolling relationship on a corresponding track, the cam member being pivoted idle on a pin fixed to the blade frame and the bearing track being fixed to said vertical translation means or vice versa, each oscillating support device also comprising a pair of cooperating toothed elements, fixed respectively to the cam member and to the bearing track, so as to allow their rolling relationship without skidding, and said toothed elements comprising at least one tooth of further depth in respect of the normal coupling profile, so as to impart to the blade frame, along said rectilinear part of the trajectory, at least one rapid jumping movement of small amplitude in a vertical direction, to impart corresponding blade percussions onto the bottom of the respective channels cut into the stone block.

2. Percussion sawing machine as in claim 1), wherein the amplitude of said at least one jumping movement in a vertical direction is between 0.3 and 10 mm.

3. Percussion sawing machine as in claim 1, wherein said teeth of further depth are formed in the rectilinear part of the toothed element fixed to the bearing track, and are alternated with teeth of normal depth.

4. Percussion sawing machine as in claim 3, wherein said rectilinear part of the toothed element fixed to the bearing track is removable, adjustable in height, and formed of material which is softer than that of the cooperating toothed element fixed to the cam member.

5. Percussion sawing machine as in claim 1, wherein said cam member is a circular sector element pivoted in correspondence of its vertex angle.

6. Percussion sawing machine as in claim 5, wherein said bearing track has a profile comprising a central rectilinear part, to which are radiused two concave end parts.

7. Percussion sawing machine as in claim 5, wherein said circular sector has a smaller radius in its central part and a wider radius in correspondence of its two end parts.

8. Percussion sawing machine as in claim 7, wherein said bearing track has a rectilinear profile.

9. Percussion sawing machine as in claim 1, wherein the amplitude of said at least one jumping movement in a vertical direction is between 1 and 5 mm.

* * * * *